United States Patent [19]

Ebert et al.

[11] 4,263,123

[45] Apr. 21, 1981

[54] ANIONIC GRAFTS OF MONOMERS ONTO COAL SUBSTRATES

[75] Inventors: Lawrence B. Ebert, New Providence; Louis Matty, Jr., East Brunswick, both of N.J.

[73] Assignee: Exxon Research & Engineering Co., Florham Park, N.J.

[21] Appl. No.: 901,602

[22] Filed: May 1, 1978

[51] Int. Cl.[3] ..... C10G 1/04; C08L 95/00

[52] U.S. Cl. ..... 208/8 LE; 260/42.25; 260/28.5 A; 44/1 R; 585/943

[58] Field of Search ..... 208/8 LE; 260/42.25; 44/1 R

[56] References Cited

U.S. PATENT DOCUMENTS

| | | | |
|---|---|---|---|
| 2,638,456 | 5/1953 | Laning | 260/42.25 X |
| 3,359,229 | 12/1967 | Chalex et al. | 260/42.25 X |
| 3,642,607 | 2/1972 | Seltaer | 208/8 |
| 3,856,175 | 12/1974 | Dunlop | 260/42.25 X |
| 3,856,745 | 12/1974 | Yamaguchi et al. | 260/42.25 X |
| 4,033,852 | 7/1977 | Horowitz et al. | 208/8 LE |
| 4,085,246 | 4/1978 | Buser et al. | 260/42.25 X |

FOREIGN PATENT DOCUMENTS 9052286 of 0000 Japan .
9052287 of 0000 Japan .

OTHER PUBLICATIONS

Chemistry of Organic Compounds, Carl R. Noller, W. B. Saunders Co., Phila. Pa., London 1965, pp. 124–129.
Organo Metallic Compounds, G. E. Coater, U. of Durham, London: Methuen & Co., Ltd., N.Y., Wiley & Sons, Inc., 1960, preface–p. 2.

*Primary Examiner*—Delbert E. Gantz
*Assistant Examiner*—William G. Wright
*Attorney, Agent, or Firm*—Henry E. Naylor

[57] ABSTRACT

Anionic grafting of olefinic monomers onto coal substrates is disclosed. The process comprises grafting polymeric side chains onto coal by contacting coal with a covalently bonded alkyl or aryl alkali metal initiator to generate carbon-alkali metal bonds and then reacting these bonds with an olefinically unsaturated monomer for a time sufficient to produce a grafted coal product having polymeric side chains bonded to the coal. The resulting coal grafts evidence enhanced solubility in organic solvents, and liquids derived from the coal grafts evidence reduced sulfur content.

21 Claims, No Drawings

ANIONIC GRAFTS OF MONOMERS ONTO COAL SUBSTRATES

BACKGROUND OF THE INVENTION

1. Field of the Invention

The invention relates to improved techniques for solubilization of coal and, more particularly, to enhancing liquid hydrocarbon yields from solid coal by pretreating the coal to introduce olefinic monomers into the coal structure.

2. Discussion of the Prior Art

In recent years, the production of liquid hydrocarbons from non-petroleum sources has taken on added importance. Thus, with proven world petroleum reserves shrinking, other forms of energy have attracted attention. Much attention has been directed to coal, an abundant fossil fuel in the United States, which can be converted to liquid hydrocarbons at costs approaching current and projected costs for the refining of crude petroleum. Moreover, basic coal conversion technology exists and has been demonstrated on a variety of levels, e.g., pilot plant and full scale commercial plants. However, full development of existing conversion technology is only now underway.

A variety of processes for converting coal to oil or gas have been proposed or used in the past; see, e.g., "Coal Conversion Technology", *Chemical Engineering*, pp. 88–105 (July 22, 1974), P. A. Lahage et al, "Solubilization of Coal in Organic Media", NASA-TM-75151 (1976) "Coal Conversion—A Review", *CHEMSA*, 3, pp. 102–104 (1977) and U.S. Pat. No. 4,072,475. A major area of investigation is solvent extraction of coal; see, e.g., U.S. Pat. Nos. 3,018,241, 3,379,638, 3,642,607 and 3,966,582.

One way of increasing solubility of coal has involved graft polymerization of coal; see, e.g., Japanese Kokai 9052–286 and 9025–287, which disclose graft polymerization of coals with water soluble or water insoluble ionically or radically polymerizable monomers. A similar process is disclosed in U.S. Pat. No. 4,033,852, which discloses a process for grafting polymeric side chains onto natural coal employing a free radical catalyst system comprising a source of silver ions and a peroxide polymerization initiator and reacting coal radicals thus produced with an olefinically unsaturated monomer. A charge transfer complex of sodium naphthalide is alternatively employed. Carbonaceous grafts of polymers have also been disclosed in U.S. Pat. No. 3,856,745 and British Specification No. 1,275,619.

A problem with many of the coal stabilization schemes is that high energy input is usually required, as well as utilization of high temperature and high pressure equipment. Alternatively, expensive chemicals and/or solvents are often required, thereby making the widespread use of such techniques economically unfeasible.

SUMMARY OF THE INVENTION

In accordance with the invention, a process for forming a soluble coal product is disclosed. The process comprises grafting polymeric side chains onto coal by first contacting coal with a covalently bonded alkyl or aryl alkali metal initiator to generate carbon-alkali metal bonds and then reacting these bonds with an olefinically unsaturated monomer for a time sufficient to produce a grafted coal product having polymeric side chains bonded to the coal. The grafted coal product is then dissolved in an organic solvent which also dissolves homopolymer of the monomer.

DETAILED DESCRIPTION OF THE INVENTION

It is known that coal is a crystalline aggregate having a very complex molecular structure in which carbon atoms in the coal molecule are present in polynuclear aromatic rings, and other elements, such as sulfur, nitrogen, oxygen, etc. are distributed in this matrix as sulfides, thiols, amines, imines, hydroxyl groups, etc., without disturbing the aromatic configuration; see, e.g., U.S. Pat. No. 3,244,615. The average molecular weight of the polynuclear aromatic molecule is apparently over 2000. The molecules of coal are highly resonance stabilized, symmetrical in structure and arranged in locally planar configurations. Such arrangement results in highly cohesive forces and a compact state of aggregation, which render liquefaction and solubilization of coal extremely difficult.

Without subscribing to any particular theory, it is believed that molecular grafting of monomeric and polymeric side chains on the coal molecule in accordance with the invention breaks down the crystalline symmetry, thereby producing a more amorphous (less long range crystalline) structure having lower intramolecular forces. Furthermore, since the processes described herein are chemically reductive in nature, a further diminishment in the aggregation of coal is expected to arise from the destruction of the hydrogen-bonded tertiary structure (examples of tertiary structures include helical arrangements of macromolecules). Acidic protons, as in alcohols, phenols and carboxyl groups, will be abstracted, thereby rendering the coal more open both to attack by the olefin monomer and to solubilization by solvent molecules. The cumulative effect is to increase the solubility of coal in suitable organic solvents such as methanol, benzene, etc. and to facilitate its conversion to a liquid.

In the inventive process for grafting polymeric side chains onto coal, the coal is first contacted with a covalently bonded alkyl or aryl alkali metal initiator. Preferably, an alkali metal of lithium or sodium is employed. Examples of such initiators include n-butyllithium, phenyllithium, and methyllithium.

At least about $10^{-2}$ meq/g dry coal is the minimum amount of initiator required to obtain initiation. About 6 meq/g dry coal is the maximum amount of initiator that may be utilized without significant waste. Preferably, the concentration of initiator ranges from about $10^{-1}$ to 3 meq/g dry coal.

To aid in the initiation process, a small quantity of solvent may be added in an amount sufficient to wet the coal to help insure homogeneous dispersion of the initiator. Suitable solvents are those in which the initiator is soluble and include hydrocarbons and mixtures of hydrocarbons, such as liquid phase alkanes, e.g., n-hexane. The solvent may be recovered and recycled, if desired.

Apparently, the reaction of alkyl or aryl alkali metal with coal generates active carbon-alkali metal bonds within the coal matrix, thereby providing sites for anionic polymerization; see, e.g., B. J. Wakefield, *The Chemistry of Organolithium Compounds*, Pergamon Press, N.Y. pp. 96ff (1974). These sites, called "initiation sites", then, in the presence of unsaturated monomers, initiate a graft of the monomer to the coal matrix. Polymerization of the grafted monomer then proceeds spontaneously, preferably with agitation, and the resulting product is found to be more soluble in organic solvents than the coal alone. For example, grafting methylacrylate onto Illinois No. 6 coal increases the solubility in methanol of the product over that of the coal alone by about 334% (15.6% for coal; 48.8% for grafted coal). Similarly, the solubility of Illinois No. 6 coal alone in benzene is about 3%, while the solubility of styrene-grafted Illinois No. 6 is about 15%.

Any olefinically unsaturated monomer may be employed in the grafting process of the invention. Typical polymerizable monomers include the following: ethylene, propylene, butylene, tetrapropylene, isoprene, butadiene, olefinic petroleum fractions, styrene, vinyltoluene, methylmethacrylate, ethylacrylate, ethylhexylacrylate, t-butylacrylate, oleylacrylate, methylacrylate, stearylacrylate, mirystylacrylate, lauryl acrylate, vinyloleate, vinylstearate, vinyl mirystate, vinyl laurate and combinations of the foregoing monomers. For economic reasons, an olefinic petroleum fraction such as fast coker gas is preferred. However, prior to use, fast coker gas must be cleaned of $H_2S$, such as by scrubbing, since $H_2S$ deactivates initiation sites on the coal.

The amount of monomer added to the initiated coal ranges from about 1 to 16 meq/g coal. This amount ensures that the amount of monomer grafted is at least about 1 wt % of the initiated coal, since addition of less than about 1 wt % monomer does not greatly enhance the solubility of coal. As an example, 1 meq of styrene weighs about 0.1 g. Thus, assuming complete reaction, 1 meq styrene per 1 g initiated coal would result in a weight increase of about 10 wt %. Such weight increase with grafted styrene is sufficient to increase the solubility about 5 times over that of coal alone. A greater amount of monomer may be added, of course, to realize even greater solubilities. However, practical economic considerations dictate a maximum preferred weight increase in grafted coal over initiated coal of about 10 wt %.

The monomer is dissolved in solvent, preferably in a ratio ranging from about 1/25 to ½ monomer/solvent on a volume/volume basis. Below about 1/25 concentration will not result in grafting, while a concentration of greater than about ½ results in too much olefin per active site being employed, with consequent waste. Most preferably, the concentration of monomer in solvent ranges from about 1/5 to 1/15.

Suitable solvents are those in which both the monomer and homopolymer thereof are soluble. Examples of solvents include toluene, benzene, methanol, low volatile coker gas and recycle solvent. It should be recognized that some homopolymerization will occur and it is desirable that any oligomers thereby formed do not interfere with the coal grafting process. Further, as the coal grafting process proceeds, the grafted coal itself begins to behave as a homopolymer and accordingly will dissolve in the solvent. Examples of suitable monomer/solvent pairs include styrene/toluene, methylacrylate/methanol, and high volatile coker gas/low volatile coker gas. An example of a suitable economic solvent is recycle solvent, which is highly aromatic and which is derived from coal by liquefaction (b.p. $\leqq$700° F.).

Generally, any type of coal may be utilized in the practice of the invention, such as bituminous coal, subbituminous coal, anthracite, lignite and other solid carbonaceous materials of natural origin. Such coals have the following character: carbon content ranging from about 55 to 93 wt. %, hydrogen content ranging from about 2.2 to 6.2 wt. % and oxygen content ranging from about 2.6 to 33 wt. % (MAF basis) and H/C ratio ranging from about 0.3 to 1.1. While all such coals may be beneficially processed in accordance with the invention, certain types of coals such as bituminous and higher rank, are more readily and economically processed. Examples of such coal include Illinois No. 6 and Bruceton (Pittsburgh).

It is preferred that the coal have as high a surface area as possible for maximum grafting of monomer thereon. It is, however, not economically justifiable to pulverize coal to very fine powder. Consequently, it is desirable to expose as much coal surface area as possible without losing coal as dust or fines or as the economics of coal grinding may dictate. Accordingly, the coal is generally ground to a finely divided state and will contain particles less than about ¼ inch (6.4 mm) in size, preferably less than about −10 mesh (1.7 mm), more preferably less than about 100 mesh (150 μm), and greater than about 325 mesh (45 μm). The coal may be dried by conventional drying techniques, for example, by heating to about 100° to 110° C.

The temperature under which the process is operated is not very critical and may range from ambient to about the boiling point of the monomer solvent, which typically is below about 130° C. Preferably, ambient temperature is employed to reduce energy requirements.

The atmosphere to which the reaction may be exposed must be water-free in order to avoid reaction with the initiator to form alkali hydroxide, and preferably oxygen-free in order to avoid forming alkali oxide. Such reactions interfere with the initiation process. Examples of preferred operating atmospheres include nitrogen, hydrogen, helium and carbon dioxide and mixtures thereof, all previously dried, and preferably introduced as a blanket over the reactants.

The pressure under which the reaction is performed is not critical and accordingly, the reaction is conveniently carried out under ambient pressure conditions.

The time period in which the coal is contacted with initiator may range from about 1 to at least 24 hours, while the reaction time involved in contacting the initiated coal with monomer is substantially complete in about 1 hour. For the initiation process, about 1.5 meq/g dry coal is consumed in about 1 hour, while full initiation, consuming somewhat less than about 3 meq/g dry coal, occurs in about 24 hours. For the grafting process, the actual time selected depends on the concentration of monomer in solvent. The higher the concentration of monomer, the lower the time required for reaction. On the other hand, the higher the concentration of monomer, the more likely homopolymerization may occur.

The grafted coal product is then dissolved in an organic solvent which also dissolves homopolymer of the olefinically unsaturated monomer. Accordingly, it is convenient to maintain the coal in contact with the same solvent employed in the grafting process, rather than separating the two. Additional solvent, or, indeed other solvents, may be added, if necessary, to extract the grafted coal product from unreacted coal. The unreacted coal may then be separated from the solubilized coal product and recycled through the processing conditions described herein, if desired.

The solubilized coal product fraction has a substantially reduced sulfur content compared with the coal alone. Accordingly, soluble products derived from high sulfur coals are especially benefited by the process of the invention.

The solubilized coal product fashion prepared in accordance with the invention may be burned as a fuel or subjected to further processing to recover useful organic fractions therefrom, employing conventional coal processing and analogous petroleum processing technology.

EXAMPLES

Within a dry nitrogen glove box, a weighed amount of coal was placed in a 125 ml ground glass joint Erlenmeyer flask. A quantity of n-hexane was added sufficient to wet the coal and a measured amount of n-butyllithium (e.g., 4.5 to 6 meq/g dry coal) was added. The solution was diluted to 50 ml n-hexane (e.g., about 0.14 molar n-butyllithium) and allowed to stand unstirred for a specified time, generally at room temperature. The reaction was terminated by vacuum filtration of the coal into a fine porosity glass fitted filter.

Initiated coal was then loaded into a round bottom flask with stopcock under an atmosphere of either nitrogen or helium. Monomer (methylacrylate or styrene) with inhibitor removed was placed in a round bottom flask with stopcock. The monomer was either distilled in the dark under vacuum onto the coal or transferred directly (bulb-to-bulb) in the dark.

Results of the interactions of Illinois No. 6 coal with the monomers methylacrylate and styrene are given in Table I below. For comparison, control reactions of uninitiated coal contacted with monomer evidenced no reaction, and indeed, a weight loss (−2.0%) was found in the solid phase.

While the primary reaction of monomer and initiated coal forms a grafted coal product, with consequent weight gain over coal alone, a competing reaction is the direct solubilization of the grafted coal in the solvent in which the monomer is dissolved. Run 4 illustrates employing monomer at such a low ratio of monomer to solvent that solubilization is the predominating reaction. This result is not surprising, since initiation of coal with alkyl or aryl alkali metal can result in addition of the alkyl or aryl group to one side of a carbon-containing double bond and alkali metal to the other side. Thus, initiated coal already has alkyl or aryl groups grafted thereon. Accordingly, initiation of coal without grafting would be expected to evidence a slight weight gain. Butyllithium-initiated coal (Illinois No. 6) without monomer showed a weight gain of about 5%. Dissolution of initiated coal in benzene, however, resulted in no further weight change. Consequently, the 7.5 wt.% loss in Run 4 arose in part as a result of the presence of the monomer and direct solubilization of the grafted coal product.

TABLE I

GRAFTING ONTO ILLINOIS NO. 6* EMPLOYING n-BUTYLLITHIUM IN n-HEXANE

| Run | Treatment | Weight Change, % |
|---|---|---|
| 1 | Washed methylacrylate. Reflux | +0.5 |
| 2 | As received methylacrylate. Bulb-to-bulb transfer. | +14.6 |
| 3 | As-received methylacrylate. Bulb-to-bulb transfer. | +20.1 |
| 4 | De-inhibited styrene. Bulb-to-bulb transfer. Styrene/benzene = 1/15 vv | −7.5 |

*C = 82.0; H = 5.4; O = 9.5 (all wt. %; MAF basis); H/C = 0.785.

Solubility of grafted coal product was determined by placing 0.1 g of coal product in 15 ml solvent at room temperature for 1 hr. The phases were separated by centrifugation. Solubility was measured by the weight change of the dry solid phase. Specifically, the solubility (S) was determined by the following relationship:

$$S=(W_s-W_f)/W_i$$

where $W_s$ is the starting weight of the sample, $W_f$ is the final weight of the sample and $W_i$ is the initial weight of the coal in the sample; see Sternberg et al, Fuel, 50, 432–443 (1971). An average was taken of two trials. The results are tabulated in Table II below.

TABLE II

SOLUBILITY OF GRAFTED COALS (ILLINOIS NO. 6; n-BUTYLLITHIUM INITIATOR)

| Run | Graft Monomer | Solubilization Solvent | Solubility, % |
|---|---|---|---|
| 1 | none | methanol | 14.6 |
| 2 | methylacrylate | methanol | 48.8 |
| 3 | none | benzene | ≲3 |
| 4 | styrene | benzene | 15.4 |

The grafted coal, formed in accordance with the invention, is thus seen to be substantially more soluble than untreated coal.

In a separate experiment, a weighed amount of coal (−250 mesh Illinois No. 6) was wetted with a solution of benzene and diethyl ether in a ratio of 70:30 v/v. Phenyllithium in an amount of 2.5 meq/g dry coal was added to initiate the coal, and the solution was diluted to 100 ml with the benzene/diethyl ether. The reaction was terminated as described earlier, and the initiated coal filtered off. The initiated coal was then contacted with styrene/toluene (inhibitor removed) in a concentration of about 1/5.

Refluxing the styrene-grafted coal for 4 hours in toluene resulted in a solubility of about 14 to 19%. For comparison, refluxing coal alone in toluene results in a solubility of less than about 3%. Accordingly, grafted styrene on Illinois No. 6 coal by phenyllithium initiation is about 5 times more soluble in toluene than coal alone.

What is claimed is:

1. A process for grafting polymeric side chains onto coal which comprises contacting coal with a covalently bonded lithium initiator to generate carbon-lithium bonds and reacting said bonds with an olefinically unsaturated monomer for a time sufficient to produce the grafted coal product having polymeric side chains bonded to said coal.

2. The process of claim 1 in which the lithium initiator is selected from the group consisting of butyllithium, phenyllithium and methyllithium.

3. The process of claim 2 in which the lithium initiator is n-butyllithium.

4. The process of claim 1 in which the lithium initiator is present in an amount ranging from about $10^{-2}$ to 6 meq/g dry coal.

5. The process of claim 1 in which the olefinically unsaturated monomer is selected from the group consisting of styrene, methylacrylate and high volatile coker gas.

6. The process of claim 1 in which the monomer is present in an amount ranging from about 1 to 16 meq/g initiated coal.

7. The process of claim 1 in which the monomer is dissolved in solvent in an amount ranging from about 1/25 to ½ volume/volume.

8. The process of claim 1 in which said solvent is selected from the group consisting of toluene, benzene, methanol, low volatile coker gas and recycle solvent.

9. The product produced in accordance with the process of claim 1.

10. The process of claim 4 in which the lithium initiator is present in an amount ranging from about $10^{-1}$ to 3 meq/g dry coal.

11. The process of claim 7 in which the concentration of monomer to solvent ranges from about 1/5 to 1/15.

12. A process for solubilizing coal which comprises contacting coal with a covalently bonded lithium initiator to generate carbon-lithium bonds reacting said bonds with an olefinically unsaturated monomer for a time sufficient to produce the grafted coal product having polymeric side chains bonded to said coal and dissolving said grafted coal product in an organic solvent which also dissolves homopolymer of said olefinically unsaturated monomer.

13. The process of claim 12 in which the lithium initiator is selected from the group consisting of butyllithium, phenyllithium and methyllithium.

14. The process of claim 12 in which the lithium initiator is present in an amount ranging from about $10^{-2}$ to 6 meq/g dry coal.

15. The process of claim 12 in which the olefinically unsaturated monomer is selected from the group consisting of styrene, methylacrylate and high volatile coker gas.

16. The process of claim 12 in which the monomer is present in an amount ranging from about 1 to 16 meq/g initiated coal.

17. The process of claim 12 in which the monomer is dissolved in a solvent in an amount ranging from about 1/25 to ½ volume/volume.

18. The process of claim 12 in which said solvent is selected from the group consisting of toluene, benzene, methanol, low volatile coker gas and recycle solvent.

19. The process of claim 13 in which the lithium initiator is n-butyllithium.

20. The process of claim 14 in which the lithium initiator is present in an amount ranging from about $10^{-1}$ to 3 meq/g dry coal.

21. The process of claim 17 in which the concentration of monomer to solvent ranges from about 1/5 to 1/15.

* * * * *